United States Patent [19]

Yasuda et al.

[11] 4,087,055

[45] May 2, 1978

[54] METHOD AND MEANS FOR MOUNTING A DRIVE ROLL IN A HIGH SPEED WINDER

[75] Inventors: Kazuyoshi Yasuda; Harumi Hasegawa, both of Nagoya; Yoshihiko Hosokawa, Aichi, all of Japan

[73] Assignee: Mitsubishi Jukogyo Kabushiki Kaisha, Tokyo, Japan

[21] Appl. No.: 728,917

[22] Filed: Oct. 4, 1976

[30] Foreign Application Priority Data

Oct. 30, 1975 Japan ..... 50-130912

[51] Int. Cl.[2] ..... B65H 54/42; B65H 54/52

[52] U.S. Cl. ..... 242/18 DD

[58] Field of Search ..... 242/18 DD, 18 R

[56] References Cited

U.S. PATENT DOCUMENTS 492,613 2/1893 Pierce ..... 242/18 DD 3,970,260 7/1976 Bruggisser et al. ..... 242/18 DD

FOREIGN PATENT DOCUMENTS 1,053,321 9/1953 France ..... 242/18 DD

*Primary Examiner*—George F. Mautz

*Attorney, Agent, or Firm*—Cushman, Darby & Cushman

[57] ABSTRACT

The present invention provides a way of mounting a drive roll in a high speed winder, in which a drive roll bracket for holding a drive roll is pivotally supported by a pivot whose axis is an intersection line between a vertical plane equally dividing a distance between opposite remote end surfaces of a wound thread package and a horizontal plane that is tangential to a bottom surface of the drive roll or a horizontal plane in the proximity thereof, and a press contact force between said drive roll and the bobbin holder shaft or wound thread package is applied entirely by the intermediary of said pivot.

2 Claims, 5 Drawing Figures

METHOD AND MEANS FOR MOUNTING A DRIVE ROLL IN A HIGH SPEED WINDER

BACKGROUND OF THE INVENTION

FIG. 1 is a side cross-sectional view showing one example of winders in the prior art, in which a drive roll 1 is held from a drive roll bracket 2, and it also forms a motor-containing roll which rotates when an electric power is received from a power source 3. The drive roll bracket 2 has its one end fixedly secured to a slider 4. Accordingly, if the slider 4 slides vertically along a guiderail 5, then the drive roll 1 also slides vertically together with the bracket 2. Reference numeral 6 designates a bobbin holder, which is rotatably supported by a bearing 8 fitted in a frame 7, and which also can tightly fit and hold a bobbin around its outer circumference by publicly-known means. Accordingly, if the drive roll 1 is driven as press contacted onto the surface of a bobbin (not shown) held around the outer circumference of the bobbin 6, then the bobbin and the bobbin holder rotate at such rotational speed that they have a circumferential speed equal to the circumferential speed of the drive roll 1, so that when a yarn is supplied while being traversed on the circumference of the bobbin, the yarn is positively wound to form a wound thread package 9. Though various means (not shown) have been known with respect to the structure for applying the press contact force against the wound thread package 9 and the bobbin to the drive roll 1, in any way it is an essential condition for obtaining a wound thread package of good shape to apply a press contact force P that is uniform along the widthwise direction of winding of the wound thread package 9 and that is appropriate. Especially, in case that two or more wound thread packages 9 are formed on a bobbin holder 6 as shown in FIG. 1, or even in case that a single wound thread package 9 is formed if the width of winding becomes large, then the press contact force is apt to become uneven along the direction of width of the winding, so that a wound thread package of good and uniform quality is hardly obtained. In addition, for the purpose of applying a press contact force that is uniform along the direction of width of the winding, it is necessary that the bobbin holder 6 and the drive roll 1 should maintain a very good parallelism over the entire region of the sliding interval of the slider 4, and further, it is necessary that the bobbin holder 6 which has a smaller diameter than the drive roll 1 and which is cantilever supported should have a higher rigidity and should not be flexed by the press contact force P and the weight W of the wound thread package. Accordingly, it has been heretofore necessitated to raise the design rigidity of the bobbin holder 6 as high as possible to maintain high working accuracies, such as straightness, rightness, fitting tolerance, etc. of the respective parts, such as the frame 7, guiderail 5, slider 4, drive roll bracket 2 and drive roll 1, and also to raise the accuracy in assembly. The above-mentioned is an example which has been manufactured and used up to a winding speed of about 2,000 m/Min. though it has been accompanied with difficulties. However, recently, in the spun yarn winding process for synthetic fiber yarns, a spin-draw system or a POY (partially orientated yarn) system has been developed. In these systems, a winder for a high speed large package (a large wound thread package) having a winding speed of 3000–4000 m/Min. is required, and further, if the rotational speed of the bobbin holder is raised up to 12,000–14,000 rpm and if the cantilever projection length is extended up to 350–500 mm, then with the simple bearing support, as shown in FIG. 1, the bobbin holder would resonate within the operating rotational speed range, so that a violent vibration is generated which makes winding impossible. Therefore, a winder, as shown in FIG. 2, has been proposed.

Explaining now the principles of a way of avoiding said resonance with reference to FIG. 2, reference numeral 10 designates a motor-containing drive roll held by a drive roll bracket 11, and said drive roll bracket 11 has its one end fixedly secured to a slider 12. This slider 12 is constructed in such manner that it can slide vertically up and down along a guiderail (not shown) and it can apply a press contact force to a bobbin and a wound thread package (not shown) on a bobbin holder 13 with publicly-known means, and with respect to this point, the construction is similar to that shown in FIG. 1. Reference numeral 14 designates a bobbin holder shaft for the bobbin holder 13, which is rotatably supported by bearings 17 which are resiliently supported from a frame 15 via springs 16. The thus constructed bobbin holder 13 and bobbin holder shaft 14 in FIG. 2 can have their lower order resonant rotational speed set as an specific value within a given range by appropriately selecting their weight distribution and the elasticity of the springs 16, and therefore, if this is set at a value lower than the operating range, then the vibration that is harmful for winding can be prevented. In addition, since the bobbin holder 13 and the bobbin holder shaft 14 are resiliently supported from the frame 15 via springs 16, they can maintain their straightness without being flexed even under a lower order resonant state (lower than the operating range) or even at an operating state exceeding the resonant point. However, in order to obtain a good wound thread package with a winder having such construction, the problem of incorrect parallelism between the drive roll 10 and the bobbin holder 13 must be resolved.

FIG. 2 shows an initial winding state where a wound thread package is not yet formed. Since the bobbin holder 13 and the bobbin holder shaft 14 are inclined in the direction of a press contact force P while almost maintaining their straightness owing to compression of the springs 16 when they are applied with the press contact force P by the drive roll 1, the press contact force distribution on the bobbin is as shown by a number of graduated arrows in FIG. 2, that is, the force is larger on the bearing side and it is smaller towards the opposite side. Then, as the wound thread package 18 grows and its weight W becomes successively larger, as shown in FIG. 3, the bobbin holder 13 and the bobbin holder shaft 14 are integrally inclined substantially, so that almost all the press contact force P is applied to the end of the wound thread ball on the bearing side, and thus there occurs irregular traverse or yarn drop along the end face of the wound thread package on the bearing side, which makes the winding impossible. Strengthening the springs 16 to reduce the inclination of the bobbin holder 13 would result in the rise of a resonant point, and since high speed winding becomes impossible because of violent vibration, this approach cannot be a solution. As described above, in a high speed winder, the way of mounting the drive roll in the prior art had a defect in itself.

SUMMARY OF THE INVENTION

The inventors of the present invention encountered the problem of vibration of the bobbin holder in the course of development of a high speed winder, and so they have succeeded in the solution of this problem by making improvements in the way of supporting a bobbin holder shaft. When a yarn was practically wound at a high speed according to the above-described method, yarn drop along an end face or deformation occurred and thus a good wound thread package could not be obtained. It has been found that this is caused by the fact that the bobbin holder shaft is inclined depending upon the press contact force and the weight of the wound thread package because it is resiliently supported and thereby the press contact force of the drive roll becomes uneven along the widthwise direction. On the other hand, it has been noticed that the drive roll can be solely mounted because of its motor-containing type, and the present invention has been worked out by finding out the fact that it is only necessary to incline the drive roll along the inclined bobbin holder. More particularly, the present invention provides a way of mounting a drive roll in a high speed winder, in which a drive roll bracket for holding a drive roll is pivotally supported by a pivot whose axis is an intersection line between a vertical plane equally dividing a distance between opposite remote end surface of a wound thread package and a horizontal plane that is tangential to a bottom surface of the drive roll or a horizontal plane in the proximity thereof, and a press contact force between said drive roll and the bobbin holder shaft or wound thread ball is applied entirely by the intermediary of said pivot.

The principles of the invention will be further discussed with reference to the drawing wherein a preferred embodiment is shown. The specifics illustrated in the drawing are intended to exemplify, rather than limit, aspects of the invention as defined in the claims.

DETAILED DESCRIPTION OF THE PRESENTLY PREFERRED EMBODIMENT

Figure 1:
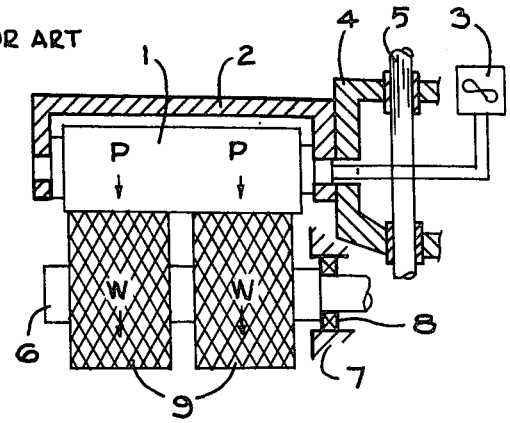
FIG. 1 PRIOR ART
FIG. 1 is a longitudinal cross-sectional view showing one example of the winders in the prior art.
Figure 2:
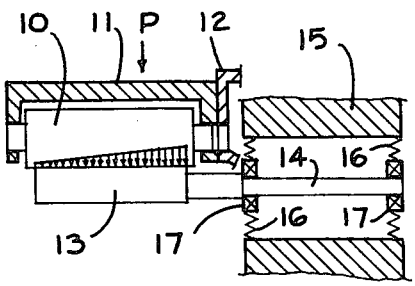
FIG. 2 PRIOR ART
FIG. 2 is a diagrammatic view for illustrating a principle of a way of avoiding resonance in the winders in the prior art.
Figure 3:
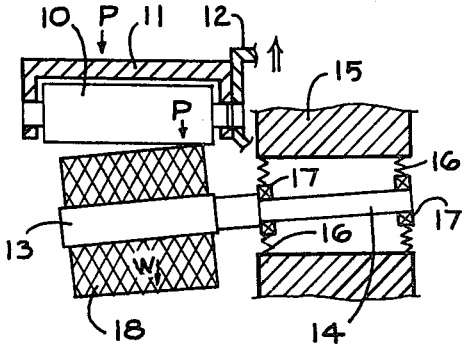
PRIOR ART FIG. 3
FIG. 3 is a diagrammatic view showing the same apparatus as that shown in FIG. 2 but in a different operating state.
Figure 4:
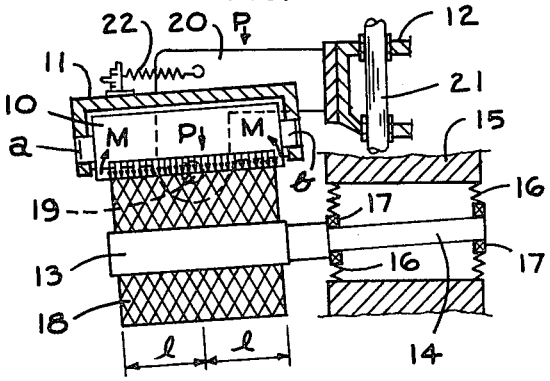
FIG. 4 is a longitudinal cross-sectional view of a high speed winder showing one preferred embodiment of the present invention.
Figure 5:
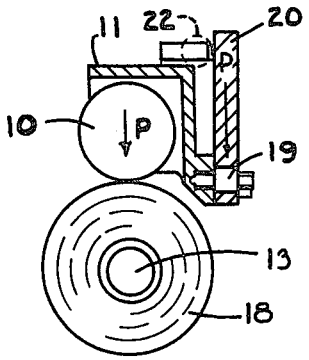
FIG. 5 is a transverse cross-sectional view of the same.

Explaining now one preferred embodiment of the invention illustrated in the drawings, FIG. 4 is a fragmentary longitudinal cross-sectional view of a high speed winder showing one preferred embodiment of the present invention, and FIG. 5 is a fragmentary transverse cross-sectional view of the same. In these figures, a drive roll 10 is a motor-containing type of roll, which is rotatably supported from a drive roll bracket 11. The drive roll bracket 11 is rockably coupled to a support arm 20 via a pivot 19. The pivot 19 has its axis along an intersection line between a vertical plane equally dividing a distance between opposite remote end surface of the wound thread package 18 and a horizontal plane that is tangential to a bottom surface of the drive roll 10. The support arm 20 is fixedly secured to a slider 12, so that it can slide vertically along a guiderail 21. Accordingly, if a press contact force is applied to the slider 12 with publicly-known means, then the drive roll 10 makes contact under pressure with the surface of the bobbin holder 13 or wound thread package 18 at a predetermined press contact force, so that a torque generated by a motor (not shown) contained within the drive roll can be transmitted to a bobbin (not shown) that is tightly secured to and held by the outer circumference of the bobbin holder or to a wound thread package thereon. The bobbin holder 13 is integrally formed with the bobbin holder shaft 14, which is rotatably supported by the bearings 17 which are in turn resiliently supported from a frame 15 via springs 16.

A spring 22 has its opposite ends fixedly secured to a drive roll bracket 11 and a support arm 20, and it serves to compensate for unbalance of the weight of the drive roll 10 and the drive roll bracket 11 on the opposite, left and right sides with respect to the pivot 19.

Explaining now the operation, if a predetermined press contact force P is applied the slider 12 with publicly-known means, then said press contact force P is transmitted to the drive roll bracket 11 via the support arm 20 and the pivot 19, and eventually this is converted to the forces applied to the holding portions *a* and *b* of the drive roll 10 at its opposite ends. Owing to these forces, the drive roll 10 makes contact under pressure with the bobbin or the wound thread package 18, and since the pivot is positioned at a point equally dividing a distance between the opposite remote ends of the wound thread package, the press contact force applied to the wound thread package is uniform on the left and right sides of the pivot 19 regardless of the positions of said holding portions *a* and *b*. More particularly, paying attention to the press contact reaction force which is applied to the drive roll, if it is not uniform on the left and right sides, then the reaction force moments M of the left and right portions with respect to the pivot 19 are different, so that the drive roll 10 will be inclined up to such angle that the reaction force moments on the left and right sides become equal, and in this way the drive roll is balanced at an inclination that is identical to the inclination of the bobbin holder 13. However, it is to be noted that such balancing can occur only in case that the unbalance of weight of the drive roll 10 and the drive roll bracket 11 on the left and right sides with repect to the pivot 19 has been offset by the spring 22, and that it is necessary to minimize the amount of unbalance of weight of the drive roll 10 and the drive roll bracket 11 on the left and right sides with respect to the pivot 19.

In other words, if the unbalance is large, then the spring 22 for offsetting the unbalance becomes a strong one, and with such a strong spring, the spring force caused by compression or elongation of the spring when the drive roll bracket 11 is inclined becomes relatively large, so that uniformity of the press contact force is lost. In addition, it is necessary to dispose the bobbin holder shaft 14 and the drive roll 10 within the same vertical plane, and this is for the purpose of limiting the inclination of the bobbin holder 13 and the drive roll 10 to within a vertical plane so as to match with the direction of the pivot 19.

Further, in case that the weight of the drive roll 1 is light and its length is short, and also that there is a fear that rocking vibration of the drive roll 1 about the pivot may be caused by unevenness of the wound threadpackage, then an effective damper could be provided between the drive roll bracket 11 and the support arm 20. It is a matter of course that such a modified construction does not contravene the spirit of the present invention. In the following Table 1, the practice, according to the present invention, and the heretofore known method for mounting a roll are compared with respect to a practical example, and from this table it is clear that the practice, according to the present invention, is a considerable improvement.

TABLE 1

| | Prior Art Practice | Practice According to the Present Invention |
|---|---|---|
| Winding speed | 3,500 m/Min. | the same as the left |
| Wound yarn | PET 260d (after wound) | the same as the left |
| Winding tension | 80 g | the same as the left |
| Traverse angle | 7° (deg) | the same as the left |
| Press contact force | 8 kg | the same as the left |
| Length of a wound thread package | about 300 mm, single yarn wound | the same as the left |
| Bobbin outer diameter | 89 mm | the same as the left |
| State of winding | At a wound diameter of 95-100 $\phi$, crumbling arose at the face of the wound thread package on the bearing side. | Winding could be achieved without any problem up to a wound diameter of 230 $\phi$ or more. |
| Displacement of the tip end of the bobbin holder when wound to a large diameter | impossible to measure | lowered by about 1 mm |
| Drive roll resonant point | about 40 Hz | about 20 Hz |

As described in detail above, according to the present invention, what was impossible to wind at a high speed in the prior art becomes possible to wind, and also without extremely enhancing an accuracy in the vertical direction of the drive roll and the bobbin holder they can be automatically brought to a parallel state, so that the design and assembly of the apparatus becomes easy. In addition, according to the present invention, the press contact forces between the drive roll and the bobbin holder or the wound thread package are balanced so that the moments on the opposite sides of the pivot may become equal to each other, and since the wound thread package is symmetrical with respect to the pivot, the press contact forces are also equal to each other. Since the axis of the pivot is positioned in a horizontal plane that is tangential to the bottom surface of the drive roll or in a horizontal plane in the proximity thereof, the relative slip between the surface of the wound thread package and the surface of the drive roll when the bobbin holder and the drive roll are inclined in parallel to each other, is very small, so that the influence of the inclination affected to the wound thread package becomes negligibly small. In addition, the bobbin holder undergoes only a vertical force component and is thus inclined within a vertical plane, and the drive roll also is inclined within the vertical plane following the bobbin holder because of the fact that the pivot axis is perpendicular to the bobbin holder shaft and is located in a horizontal plane, so that the parallelism between the bobbin holder and the drive roll can be maintained regardless of the diameter of the wound thread package.

We claim:

1. In a high speed winder of the surface drive type, including a bobbin holder shaft having a bobbin holder at one thereof, means resiliently supporting said shaft for rotation about the longitudinal axis thereof in order to reduce a resonant point; a motor-containing drive roll a drive roll bracket, said drive roll being journalled in said drive roll bracket for rotation about the longitudinal axis thereof for winding a thread package on the bobbin holder means forcibly pressing said drive roll into surface driving contact with the thread package being wound on the bobbin holder, the bobbin holder shaft and drive roll being substantially parallel, substantially horizontally extending and disposed with their longitudinal axes in the same imaginary substantially vertical plane, the improvement comprising:

pivot means pivotally supporting said drive roll bracket about an axis which forms an imaginary intersection line between an imaginary vertical plane which bisects transversally the thread package being wound and an imaginary horizontal plane at least approximately tangent to the bottom of said drive roll, so that the press contact force for rotating the bobbin holder shaft from the drive roll is applied entirely through the intermediary of said pivot means.

2. A method for high speed winding a thread package on a spindle comprising:

placing the spindle on a spindle holder having a spindle holder shaft extending axially from one end thereof and resiliently supporting the spindle holder shaft for rotation about its own longitudinal axis;

disposing a motor-containing drive roll in forcibly pressed surface contact with the spindle and then with the thread being wound thereon operating the motor to rotate the spindle;

while pivotally supporting the drive roll for pivotal movement about an axis which forms an imaginary intersection line between an imaginary vertical plane which bisects transversally the thread package being wound and an imaginary horizontal plane at least approximately tangent to the bottom of said drive roll; and rotating the bobbin holder shaft from the drive roll with rotative press contact force applied entirely through the intermediary of said pivotal supporting of the drive roll.

* * * * *